US007165993B2

(12) United States Patent
Fukamachi et al.

(10) Patent No.: US 7,165,993 B2
(45) Date of Patent: Jan. 23, 2007

(54) CONNECTOR AND METHOD OF MOLDING A CONNECTOR

(75) Inventors: Makoto Fukamachi, Yokkaichi (JP); Kenji Inoue, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 23 days.

(21) Appl. No.: 10/871,481

(22) Filed: Jun. 18, 2004

(65) Prior Publication Data

US 2004/0259417 A1 Dec. 23, 2004

(30) Foreign Application Priority Data

Jun. 19, 2003 (JP) ..... 2003-175275

(51) Int. Cl.
*H01R 13/40* (2006.01)

(52) U.S. Cl. ..... 439/595

(58) Field of Classification Search ..... 439/595, 439/744, 871, 752, 597, 600, 733.1
See application file for complete search history.

(56) References Cited

U.S. PATENT DOCUMENTS 5,256,083 A 10/1993 Yamamoto
5,529,515 A * 6/1996 Ohtaka et al. ..... 439/595
5,626,499 A * 5/1997 Yagi et al. ..... 439/595
6,165,011 A * 12/2000 Fukuda ..... 439/595
6,244,900 B1 * 6/2001 Ishikawa et al. ..... 439/744
6,655,993 B1 * 12/2003 Yamamoto ..... 439/595

* cited by examiner

*Primary Examiner*—Felix O. Figueroa
(74) *Attorney, Agent, or Firm*—Gerald E. Hespos; Anthony J. Casella

(57) ABSTRACT

A mold-removal hole (60) formed upon forming a locking portion (39) and communicating with a tab insertion hole (31) is formed before a locking portion (39) by partly cutting a wall of the tab insertion hole (31). As this mold-removal hole (60) is formed, preventing portions (70) for preventing a displacement of the tab (22) inserted into the tab insertion hole (31) toward the mold-removal hole (60) are formed on the wall of the tab insertion hole (31) at the lateral sides of the mold-removal hole (60) and at the opposite widthwise outer sides of the locking portion (39). By displacing the position of the locking portion (39) toward one widthwise side from the center of the cavity (32), the preventing portion (70) provided at the other side is set to have an increased area of engagement with the tab (22).

6 Claims, 7 Drawing Sheets

CONNECTOR AND METHOD OF MOLDING A CONNECTOR

BACKGROUND OF THE INVENTION

1. Field of the Invention

The invention relates to a connector with a lock for a terminal fitting.

2. Description of the Related Art

U.S. Pat. No. 5,256,083 discloses a female connector that has a housing with opposite front and rear ends. Cavities extend through the housing from the front end to the rear end, and female terminal fittings can be inserted into the cavities from behind. Locks are cantilevered forwardly from the bottom walls of the cavities and lock the terminal fittings in the cavities. A tab insertion hole is formed in the front wall of each cavity to permit the entrance of a tab of a mating male terminal fitting from the front.

Mold-removal holes are formed in the front of the housing to accommodate molds required to form the cantilevered locks. The mold-removal holes cut into middle parts of the bottom surfaces of the tab insertion holes.

FIG. 7 illustrates a male connector with a cavity construction similar to the above-described female connector. A tab 1 of a male terminal fitting in the cavity is inserted through a tab insertion hole 2, as shown in FIG. 7. The tab 1 contacts the inner periphery of the tab insertion hole 2 to prevent loose movement and is supported from below by receiving portions 3 at the opposite sides of the bottom surface of the tab insertion hole 2.

Each cavity can be made smaller to meet a demand for miniaturization of the male connector. However, a narrower lock 4 may not adequately hold the terminal fitting. The width of the cavity may be reduced without reducing the width of the lock 4, but the width of a mold-removal hole 5 must correspond to the width of the lock 4. Thus, narrowing the cavity without narrowing the lock 4 increases the proportion of the bottom surface of the tab insertion hole 2 cut by the mold that forms the lock 4 and decreases the sizes of the receiving portions 3 at the opposite sides of the bottom surface of the tab insertion hole 2, as shown in FIG. 7. As a result, the receiving portions 3 may not support the tab 1 securely, and there is a possibility that the tab 1 will displace towards the mold-removal hole 5. Movement of the tab 1 can hinder a connecting operation of the male and female connectors.

The present invention was developed in view of the above problem, and an object thereof is to securely support a portion of a terminal fitting even upon the miniaturization of a connector.

SUMMARY OF THE INVENTION

The invention relates to a connector with a housing. At least one cavity is formed in the housing to accommodate at least one terminal fitting. An insertion hole is formed at the front end of the cavity. A lock extends substantially along the cavity for locking the terminal fitting inserted into the cavity. A mold-removal hole is provided before the lock to accommodate the mold for forming the lock. The mold-removal hole is formed by partly cutting a wall of the insertion hole and hence communicates with the insertion hole. At least one preventing portion is formed at a lateral side of the mold-removal hole and at a widthwise outer side of the lock as the mold-removal hole is formed. The preventing portion receives an engagement portion of the terminal fitting and ensures that the terminal fitting will not displace from the insertion hole towards the mold-removal hole. The position of the lock is displaced from the center of the cavity towards one widthwise side in a direction at an angle to the inserting direction of the terminal fitting into the cavity.

The lock must be relatively wide in situations where the cavity is narrow. Thus, a proportion of the wall of the tab insertion hole to be cut is increased since the width of the mold-removal hole for forming the lock is set in accordance with the width of the lock. As a result, an area taken up by the preventing portion is smaller by this amount.

The preventing portions at the opposite first and second sides of the tab insertion hole are narrowed equally if the center of the lock coincides with the center of the cavity along the widthwise direction and areas of engagement of both preventing portions with the tab inserted into the tab insertion hole are reduced at the same rate. Thus, neither preventing portion can sufficiently receive the tab, and the tab may displace towards the mold-removal hole. However, the lock of the subject invention is displaced towards the first widthwise side from the center of the cavity, thereby increasing an area of engagement between the preventing portion and the tab at the second side. Therefore, the tab can be received securely at the second side and will not displace towards the mold-removal hole.

An area of engagement of the preventing portion at the second side with the engagement portion of the terminal fitting is increased by an amount substantially corresponding to the displacement of the lock towards the first widthwise side from the center of the cavity.

The terminal fitting preferably is a male terminal fitting and the engagement portion of the terminal fitting comprises a tab.

The engagement portion of the terminal fitting preferably is integrally or unitarily provided on the terminal fitting and is inserted through the insertion hole. The engagement portion is held tightly between the preventing portion and the wall of the insertion hole substantially facing the preventing portion to prevent loose movements. Thus, a position of connection with a mating terminal inserted from the front is determined to ensure a smooth connecting operation with the mating terminal.

The preventing portion preferably is provided at each of the opposite sides of the bottom surface of the insertion hole and preferably is longer along an inserting direction of the terminal fitting than the top surface wall of the insertion hole. Thus, areas of engagement of the preventing portion with the inserted tab can be increased to further enhance a force for supporting the tab.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector according to the invention is identified by the numeral 10 in FIGS. 1 to 6. The connector 10 has a plurality of male terminal fittings 20, and a housing 30 made e.g. of a synthetic resin accommodates the terminal fittings 20. The end of the connector 10 that mates with a mating connector will be referred to herein as the front.

Figure 5:
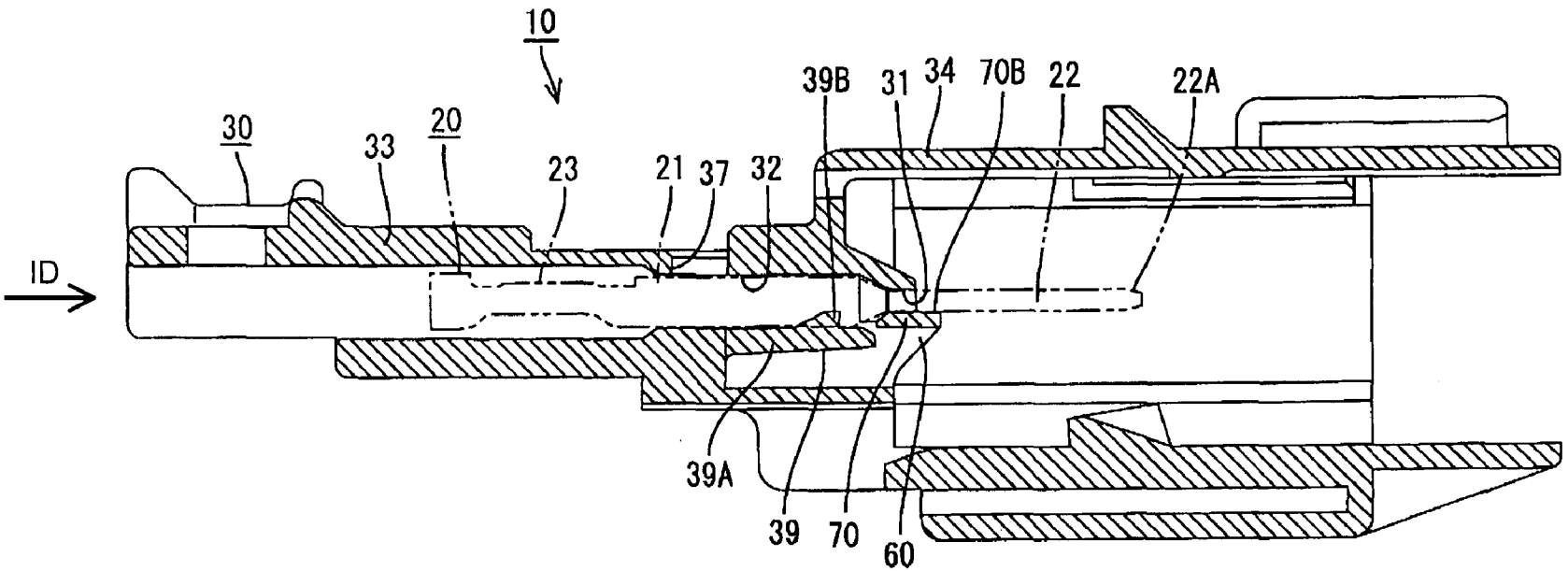
FIG. 5 is a lateral section of the connector.

As shown in phantom in FIG. 5, each terminal fitting 20 has a substantially rectangular tubular main portion 21. A long narrow tab 22 projects forward from the main portion 21, and a wire crimping portion 23 extends back from the main portion 21. The wire crimping portion 23 is configured to be crimped, bent or folded into connection with an unillustrated wire. The tab 22 has a wide rectangular cross section, and slanted or rounded guiding surfaces 22A are formed at the leading end thereof. The bottom wall of the main portion 21 is partly cut or recessed to form a lock hole (not shown), and the upper wall thereof is partly cut or recessed to form a lock hole.

Figure 3:
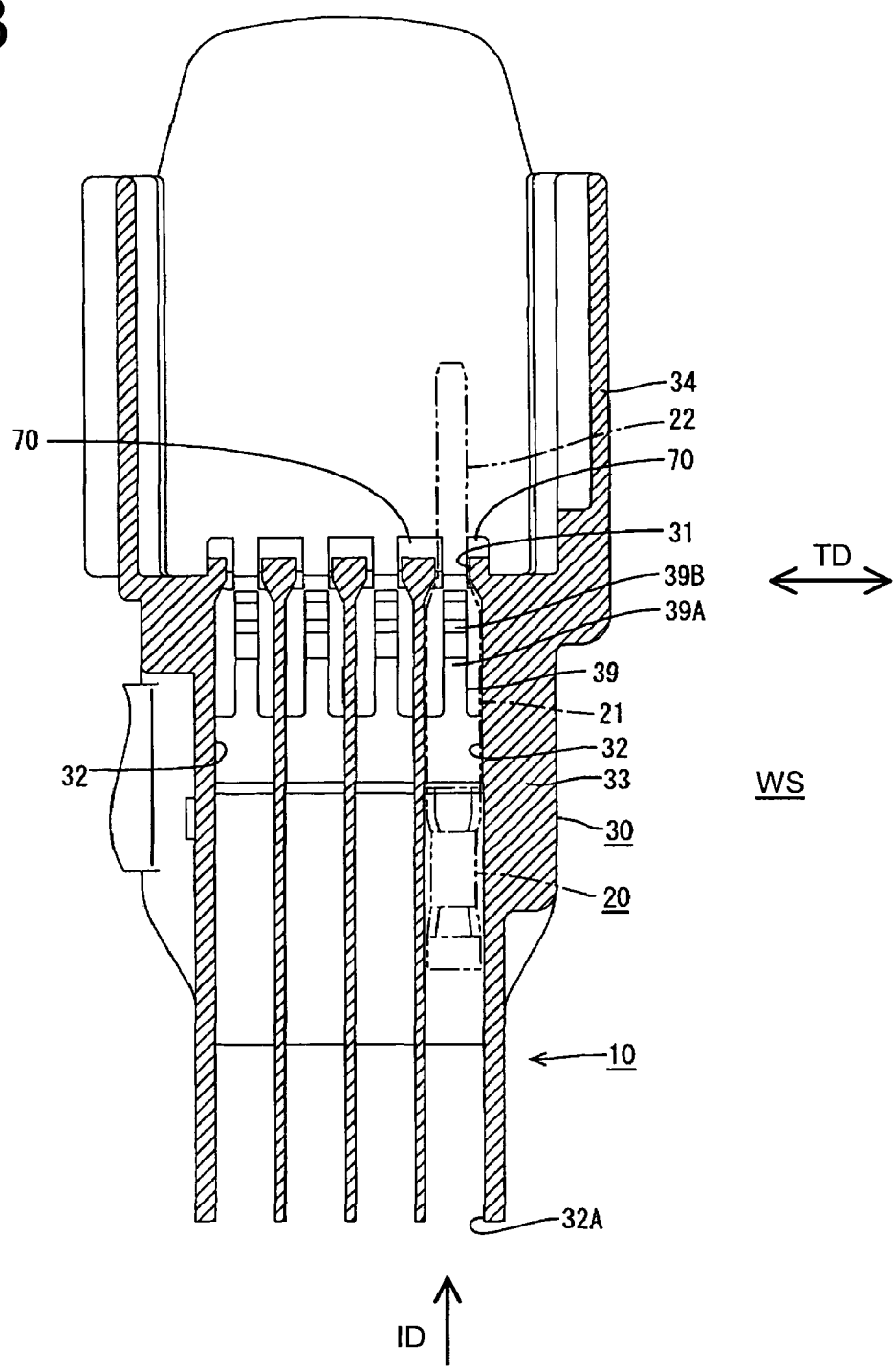
FIG. 3 is a lateral cross section of the connector.

The housing 30 has cavities 32 arranged in a transverse direction TD at one or more stages in a terminal accommodating portion 33 of the housing 30, as shown in FIG. 3. A receptacle 34 projects forward from a front edge of the terminal accommodating portion 33. The terminal fittings 20 can be inserted into the cavities 32 from behind and along an insertion direction ID. Thus, the tab 22 of each terminal fitting 20 projects into the receptacle 34. A retainer mounting portion 35 is recessed in a front part of the upper surface of the terminal accommodating portion 33 for receiving a retainer 40. The retainer 40 is joined unitarily with the terminal accommodating portion 33 by a resiliently deformable hinge 36 on one side of the terminal accommodating portion 33. Thus, the retainer 40 can be turned about the hinge 36 and onto the retainer mounting portion 35. Accordingly, the retainer 40 can engage the terminal fittings 20 at a substantially right angle to the inserting direction ID.

Figure 6:
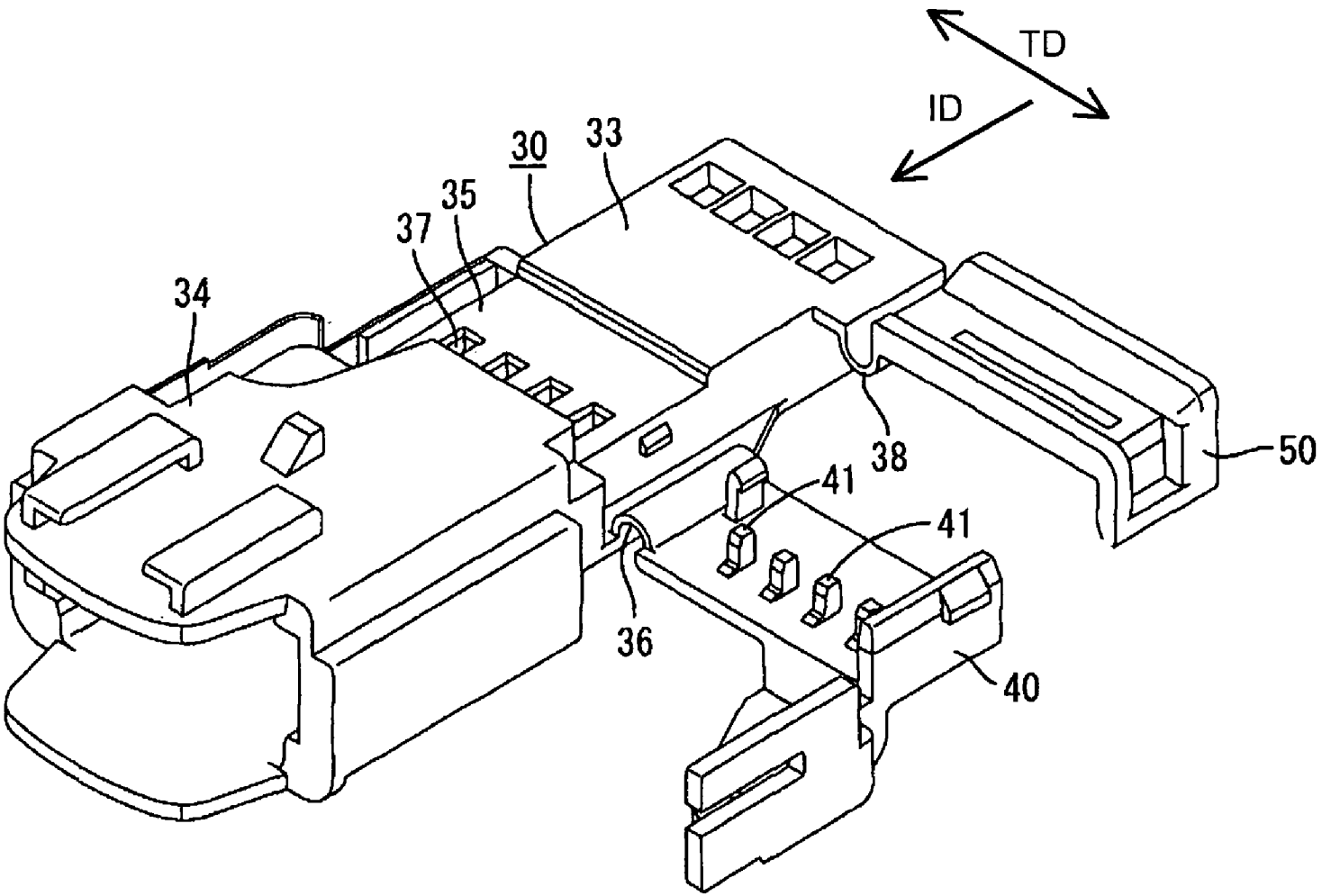
FIG. 6 is a perspective view of the connector.
Figure 7:
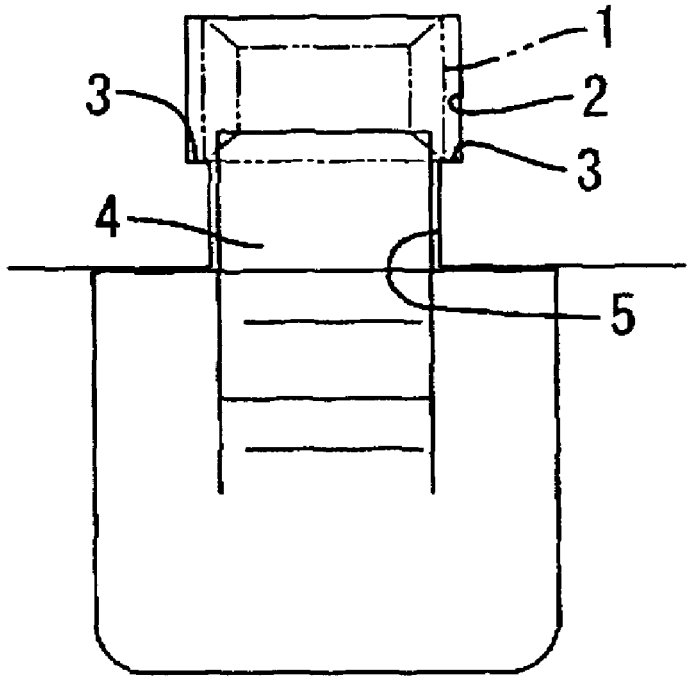
FIG. 7 PRIOR ART
FIG. 7 is an enlarged front view showing an essential portion of a prior art connector.

The retainer 40 has locking pieces 41 arranged substantially transversely and in conformity with the respective cavities 32 to lock the terminal fittings 20 in the cavities 32. On the other hand, the retainer mounting portion 35 of the terminal accommodating portion 33 is formed with insertion holes 37 for receiving the respective locking pieces 41. The terminal fittings 20 are inserted into the cavities 32 from behind and along the inserting direction ID until the lock holes of the terminal fittings 20 communicate with the insertion holes 37. The retainer 40 then is mounted to the retainer mounting portion 35. Thus, the locking pieces 41 pass through the insertion holes 37 and into the lock holes. Accordingly, the terminal fittings 20 are held so as not to come out. A strain relief portion 50 is joined unitarily to the terminal accommodating portion 33 by hinge 38, as shown in FIG. 6. Thus, the strain relief portion 50 can be turned about the hinge 38 for mounting on the bottom surface of the terminal accommodating portion 33. The strain relief portion 50 provides strain relief for wires connected with the respective terminal fittings 20.

Figure 1:
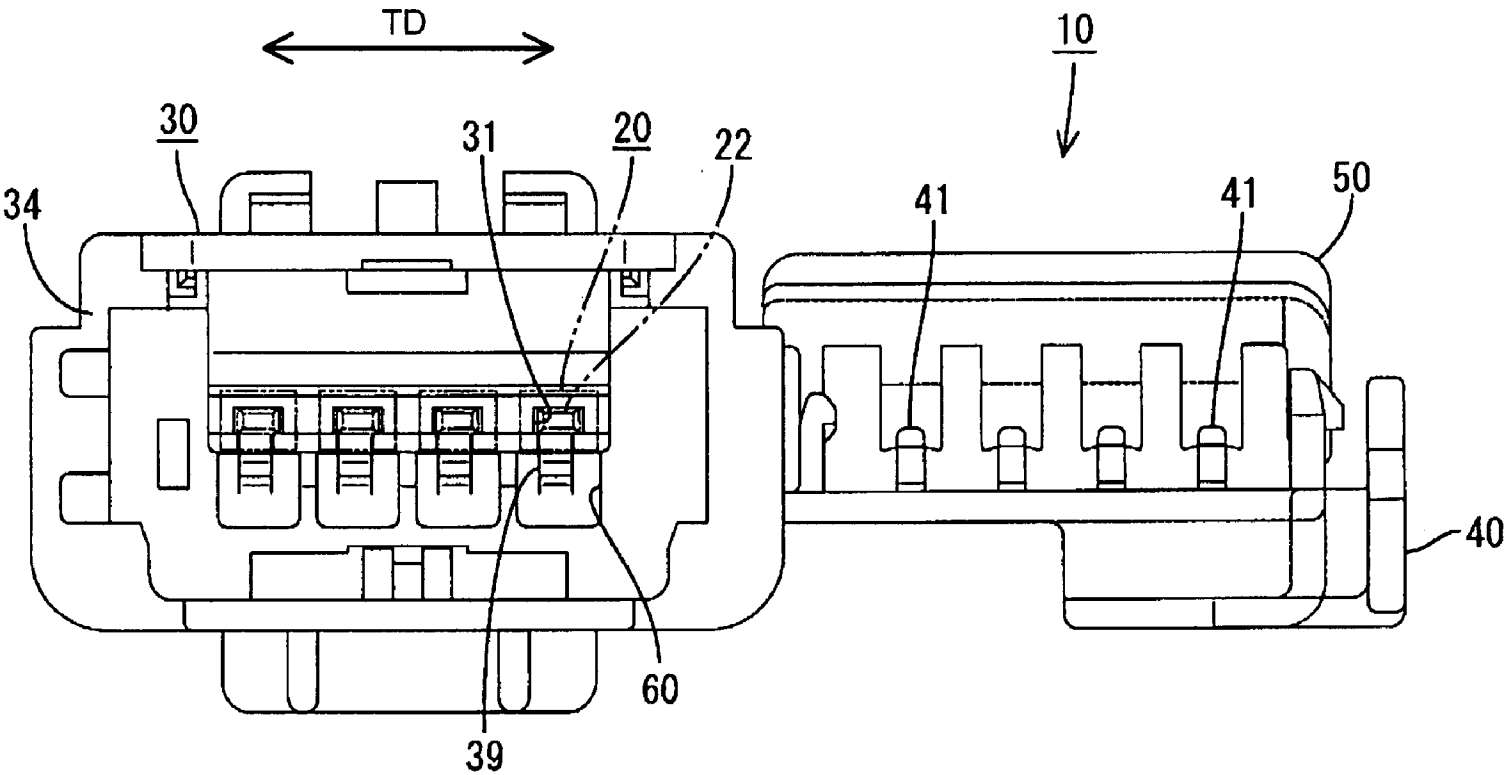
FIG. 1 is a front view of a connector according to one embodiment of the invention.
Figure 2:
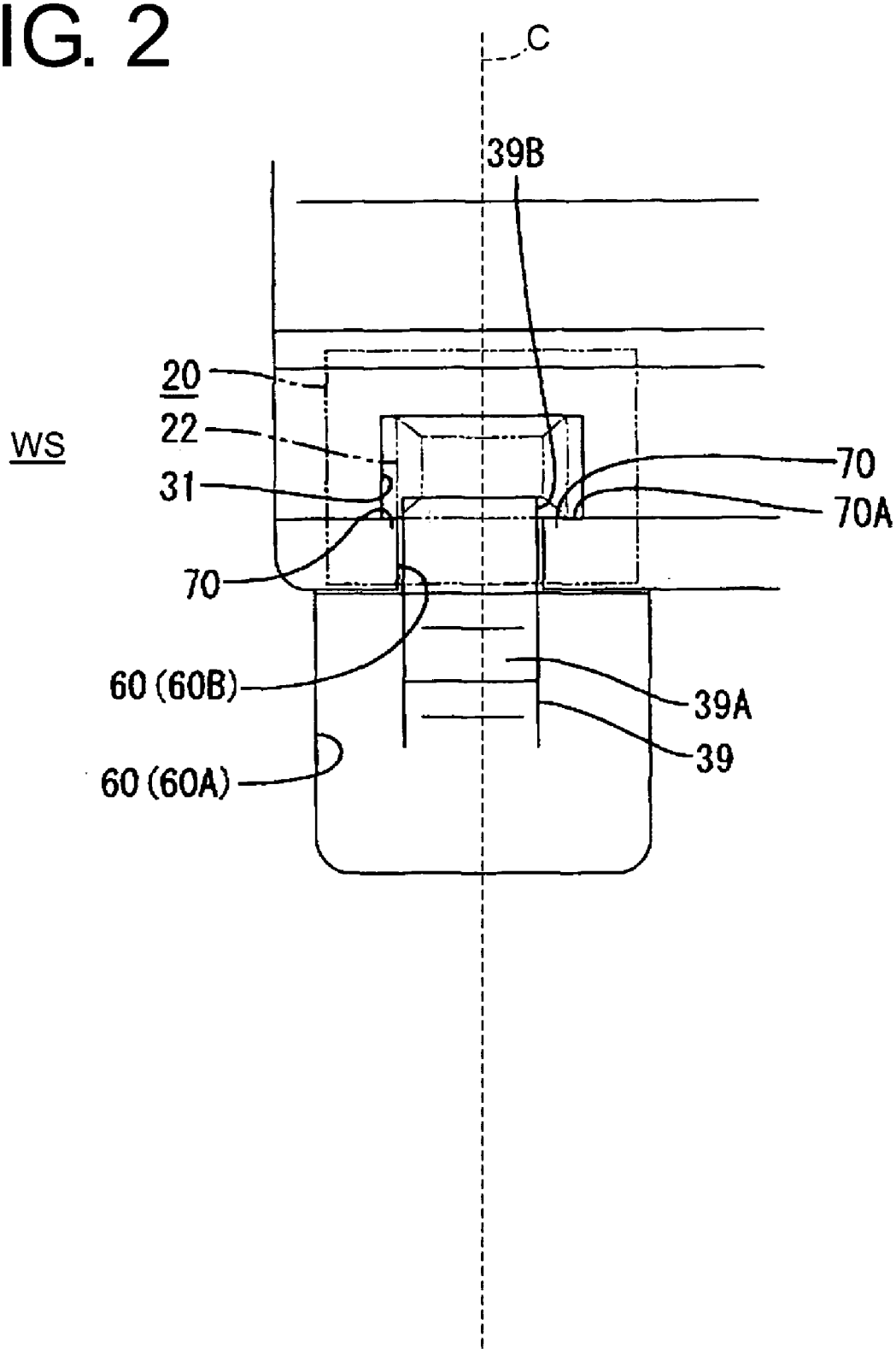
FIG. 2 is an enlarged view showing an essential portion of FIG. 1.
Figure 4:
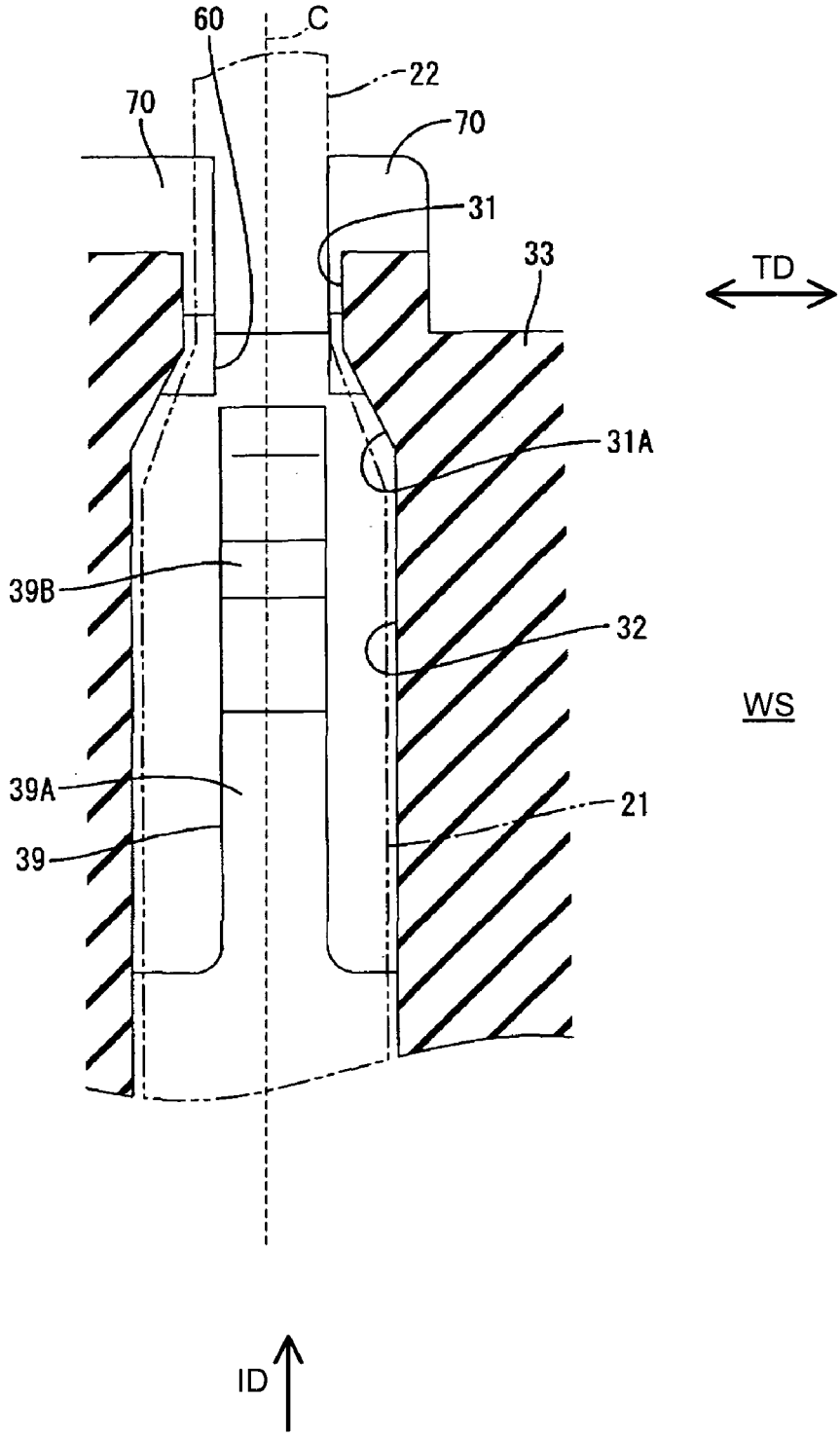
FIG. 4 is an enlarged view showing an essential portion of FIG. 3.

The cavities 32 of the housing 30 are elongate along forward and backward directions and have a substantially rectangular cross section. The rear ends of the cavities 32 define terminal insertion holes 32A in the rear surface of the terminal accommodating portion 33, whereas the front ends thereof define the tab insertion holes 31 in the front mating surface of the terminal accommodating portion 33. Each tab insertion hole 31 has a substantially rectangular cross section, as shown in FIG. 2, and the tab 22 of the terminal fitting 20 can pass into the tab insertion hole 31 while leaving tiny clearances at the left and right sides. Further, a substantially conical converging guiding surface 31A is formed at the rear side of the wall of each tab insertion hole 31 and widens backward, as shown in FIG. 4. The guiding surface 31A defines a substantially obtuse angle with respect to the inserting direction ID. Thus, the tab 22 can be brought into contact with the guiding surface 31A from behind and along the inserting direction ID for guiding into the tab insertion hole 31. It should be noted that the position of each tab insertion hole 31 substantially along the transverse direction TD is substantially in the middle of the corresponding cavity 32.

A lock 39 is formed unitarily at the bottom wall of each cavity 32 of the housing 30 for locking the terminal fittings 20. The lock 39, as shown in FIG. 5, has a resiliently deformable base 39A and a locking projection 39B. The base 39A projects forward substantially along the inserting direction of the terminal fitting 20 and extends along the bottom surface of the main portion 21 of the terminal fitting 20 inserted into the cavity 32. The locking projection 39B projects from the inner surface of the base 39A and into the cavity 32. The locking projection 39B interferes with the terminal fitting 20 as the terminal fitting 20 is inserted into the cavity 32 in the inserting direction ID. Thus, the base 39A is deformed down and out about the rear end thereof away from the cavity 32. The base 39A is restored resiliently when the terminal fitting 20 reaches a proper insertion position and returns towards its initial position. As a result, the locking projection 39B engages the locking hole of the terminal fitting 20 to prevent the terminal fitting 20 from coming out. Thus, the terminal fitting 20 is locked doubly by the lock 39 and the retainer 40.

The locks 39 are formed simultaneously with the housing 30 by unillustrated molds. More particularly, a mold for forming the forward-facing surfaces of the locks 39 is removed forward. Thus, mold-removal holes 60 are formed in the front surface of the housing 30 as this mold is removed. The locks 39 are formed so that the locking projections 39B can enter the corresponding cavities 32. Thus, the upper projecting end of each locking projection 39B partly overlaps the tab 22 of the corresponding terminal fitting 20 when viewed from the front, as shown in FIG. 2. Accordingly, the bottom side of the wall of the tab insertion hole 31 is cut so that the tab insertion hole 31 communicates with the mold-removal hole 60 located below. Each mold-removal hole 60 has a large rectangular main opening 60A below the tab insertion hole 31 and an auxiliary opening 60B that communicates with both the main opening 60A and the tab insertion hole 31.

The tab insertion hole 31 and the mold-removal hole 60 located one over the other communicate and the opening widths thereof are almost equal. Accordingly, there is little support for the tab 22, and the tab 22 inserted into the tab insertion hole 31 may be displaced toward the mold-removal hole 60. The terminal fitting 20 in the cavity 32 will incline forward if the tab 22 is displaced towards the mold-removal hole 60. However, preventing portions 70 are formed at the lateral sides of the auxiliary opening 60B of the mold-removal hole 60 and laterally out from the lock 39 for preventing displacement of the tab 22 towards the mold-removal hole 60.

The preventing portions 70 extend substantially horizontally along a transverse direction TD that is substantially normal to the inserting direction ID. Additionally, the preventing portions 70 are inward from the bottom ends of the left and right sides of the wall of the tab insertion hole 31. The tab 22 inserted in the tab insertion hole 31 may try to displace at an angle substantially normal to the inserting direction ID and towards the mold-removal hole 60. However, the opposite sides of the lower surface of the tab 22 are received by the inwardly oriented upper surfaces of the preventing portions 70. As a result, the tab 22 is prevented from displacing down towards the mold-removal hole 60. The upper surface of the preventing portion 70 is a substantially flat placing surface 70A for closely contacting the corresponding lower surface of the tab 22.

The right preventing portion 70 in FIG. 2 is wider along the transverse direction TD than the left preventing portion 70, thereby increasing an area of engagement between the right preventing portion 70 and the tab 22 inserted into the tab insertion hole 31. The preventing portions 70 are formed by displacing the lock 39 towards one side along the transverse direction TD from the centers of the cavity 32 and the tab insertion hole 31. Thus, the mold-removal hole 60 formed during the formation of the lock 39 is displaced towards one side by displacing the position of the lock 39 toward one side from the center of the cavity 32. As a result, the width of the preventing portion 70 at the other side is increased by this offset amount.

The wider preventing portion 70 is longer along the forward and backward inserting direction ID of the tab 22 than the upper, left and right sides of the tab insertion hole 31, as shown in FIG. 5. Specifically, the placing surfaces 70A of the preventing portions 70 project more forward in the inserting direction ID than the upper side of the tab insertion hole 31, and extended portions 70B corresponding to this elongated amount are formed. The extended portions 70B project more in the inserting insertion ID into the receptacle 34 than the front end of the tab insertion hole 31.

As shown in FIG. 5, the terminal fittings 20 are inserted into the respective cavities 32 of the housing 30 from behind and along the inserting direction ID. The main portion 21 of each terminal fitting 20 contacts the locking projection 39B of the corresponding lock 39 after sufficient insertion. As a result, the base portion 39A of the lock 39 deforms resiliently down in a direction intersecting the inserting direction ID. The base portion 39A is restored resiliently when the terminal fitting 20 reaches the proper insertion position so that the locking projection 39B engages the locking hole of the terminal fitting 20. The retainer 40 then is mounted into the retainer mounting portion 35 of the housing 30 so that the locking pieces 41 of the retainer 40 engage the lock holes of the respective terminal fittings 20. In this way, the retainer 40 and the locks 39 lock the terminal fittings 20 doubly. The preventing portions 70 support the base end of the tab 22 when the terminal fitting 20 reaches the proper insertion position and the leading end of the tab 22 projects through the tab insertion hole 31 and into the receptacle 34. In this state, the tab 22 is held tightly between the preventing portions 70 and the upper side of the tab insertion hole 31 substantially facing the preventing portions 70. Thus, the tab 22 is prevented from making loose movements. A mating female housing then is fit into the housing 30 from the front and the female terminal fittings thereof connect electrically with the tabs 22.

As described above, the locks 39 are displaced towards one widthwise side WS from the centers C of the cavities 32, thereby increasing the areas of engagement with the tabs 22 at the other side. Thus, sufficient support for the tab 22 is provided even if the proportion of the width of the cavities 32 taken up by the locks 39 is increased due to a miniaturization of the connector. Accordingly, the tabs 22 do not displace toward the mold-removal holes 60. Further, the tabs 22 are held tightly between the preventing portions 70 and the walls of the tab insertion holes 31 that face the preventing portions 70 to prevent loose movement. Thus, the tabs 22 can be aligned properly and can be connected smoothly with the mating terminal fittings inserted from the front without hindrance. Furthermore, the preventing portions 70 have the extended portions 70B that project forward from the upper sides of the tab insertion holes 31. Thus, the areas of engagement with the tabs 22 inserted into the tab insertion holes 31 are increased, and displacements of the tabs 22 towards the mold-removal holes 60 are suppressed.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The preventing portions are at the opposite sides of the wall of the tab insertion hole in the foregoing embodiment. However, it is sufficient for the preventing portion to be provided at either side of the wall of the tab insertion hole according to the invention.

The preventing portions receive the tab of the terminal fitting inserted into the cavity from behind and along the inserting direction in the foregoing embodiment. However, they may receive a tab of a mating terminal fitting inserted from the front according to the present invention.

The terminal fitting is locked doubly by the lock and the retainer in the foregoing embodiment. However, it may be locked only by the lock or by the retainer according to the present invention.

The invention has been described with reference to a cantilevered lock 39. However, the invention is applicable also to bridge-like lock or to a lock supported at both longitudinal ends.

The invention has been described with reference to a male terminal fitting inserted into the cavity 32. However, the invention also is applicable to female terminal fittings insertable into the cavities, wherein a front end portion of the female terminal fitting can contact the respective preventing portion for avoiding displacement towards the mold-removal hole.

What is claimed is:

1. A connector, comprising:

a housing;

at least one cavity formed in the housing to accommodate at least one terminal fitting, the cavity having a widthwise center;

an insertion hole formed at a front end of the cavity;

a lock arranged to extend substantially along the cavity for locking the terminal fitting inserted into the cavity to prevent the terminal fitting from coming out;

a mold-removal hole provided before the lock and formed by partly cutting a wall of the insertion hole to communicate with the insertion hole; and at least one preventing portion formed on the wall of the insertion hole at a lateral side of the mold-removal hole at widthwise outer side of the lock, the preventing portion being longer along an inserting direction of the terminal fitting than the wall of the insertion hole and adapted to prevent a displacement of a portion of the terminal fitting inserted into the insertion hole towards the mold-removal hole by receiving the portion of the terminal fitting, wherein the lock is positioned offset toward one widthwise side from the center of the cavity.

2. The connector of claim 1, wherein an area of engagement of the preventing portion at the other side with the portion of the terminal fitting is increased by an amount substantially corresponding to the displacement of the lock toward one widthwise side from the center of the cavity.

3. The connector of claim 1, wherein the terminal fitting is a male terminal fitting and the portion of the terminal fitting comprises a tab.

4. The connector of claim 1, wherein the portion is unitarily provided on the terminal fitting and inserted through the insertion hole, thereby being tightly held between the preventing portion and the wall of the insertion hole substantially facing the preventing portion to have loose movements thereof prevented.

5. The connector of claim 1, wherein the preventing portion is provided at each of the opposite ends of the lateral side of the wall of the insertion hole.

6. A connector, comprising:

a housing having opposite front and rear ends and a front wall at the front end of the housing;

at least one cavity extending from the rear end of the housing to the front wall of the housing alone an insertion direction for accommodating at least one terminal fitting in a rear-to-front direction;

at least one insertion hole formed through the front wall and communicating with the cavity so that the insertion hole is substantially symmetrical with the cavity in a width direction transverse to the insertion direction;

a lock formed in the cavity and integrally with the housing for locking the terminal fitting in the cavity, the lock being nonsymmetrically disposed in the cavity relative to the width direction;

the front wall including a mold removal hole substantially aligned with the lock and communicating with the insertion hole so that at least portions of the mold removal hole are nonsymmetrical with respect to the insertion hole, the front wall further including two preventing portions facing into the insertion hole on opposite sides of and substantially adjacent to the mold removal hole, one of said preventing portion being larger in the width direction than the other of the preventing portions, and a preventing portion extension projecting forward from the front wall, the two preventing portions and the prevention portion extension being adapted to prevent a displacement of a portion of the terminal fitting inserted into the insertion hole towards the mold-removal hole by receiving the portion of the terminal fitting.

* * * * *